United States Patent [19]

Hodges

[11] 4,070,018

[45] Jan. 24, 1978

[54] BALL IMPACT TARGET WITH BALL IMPACT SENSOR

[76] Inventor: Kenneth M. Hodges, 3750 Grandview Blvd., Los Angeles, Calif. 90066

[21] Appl. No.: 731,114

[22] Filed: Oct. 12, 1976

[51] Int. Cl.[2] ..... A63B 61/00

[52] U.S. Cl. ..... 273/29 A; 73/379; 273/184 R; 273/185 R; 273/102.1 R; 273/102.2 S; 273/102.4

[58] Field of Search ..... 273/26 A, 29 R, 29 A, 273/184 R, 176 B, 127 R, 127 C, 177 A, 177 B, 181 R, 103, 181 E, 181 F, 181 J, 183 R, 102 R, 102 AP, 102 S, 102.1 E, 102.1 C, 102.1 B, 102.1 F, 102.2 R, 102.2 S, 102.4, 185 R; 73/11, 12, 379, 13

[56] References Cited

U.S. PATENT DOCUMENTS

| | | | |
|---|---|---|---|
| 1,660,339 | 2/1928 | Kaufmann | 273/184 R |
| 1,761,317 | 6/1930 | Strasser | 73/379 |
| 1,882,783 | 10/1932 | Decker | 273/185 R |
| 1,969,139 | 8/1934 | Knapp | 273/184 R |
| 2,087,575 | 7/1937 | Lillell et al. | 273/29 A |
| 2,247,501 | 7/1941 | Jenks et al. | 273/181 J |
| 3,133,733 | 5/1964 | Elseroad | 273/102.2 R |
| 3,254,433 | 6/1966 | Saile, Jr. et al. | 273/184 R |
| 3,349,620 | 10/1967 | Speiser | 273/184 R |
| 3,706,451 | 12/1972 | Dixon | 273/102.1 E |
| 3,989,246 | 11/1976 | Brown | 273/102.4 |

FOREIGN PATENT DOCUMENTS

| | | | |
|---|---|---|---|
| 182,580 | 7/1922 | United Kingdom | 273/184 R |

*Primary Examiner*—William H. Grieb
*Assistant Examiner*—T. Brown
*Attorney, Agent, or Firm*—William H. Maxwell

[57] ABSTRACT

A device for ball games, sensing velocity and scoring against a damping screen comprised of areas simulating strategic plays against a player's opposition and comprised of electrical sensor means applied to the back side of the screen and of minimum mass and consisting of electrically conductive horizontal bars to be engaged by depending switch rods moved into engagement by displacement of the screen upon impact from a ball while completely absorbing impact energy, there being a plurality of bars and adjustably biased rods responsive to degrees of ball impact force, and scoring means with a display therefor.

10 Claims, 8 Drawing Figures

BALL IMPACT TARGET WITH BALL IMPACT SENSOR

BACKGROUND

The need for playback ability and scoring arises in the use of ball serving machines and in the installation of practice alleys for games such as tennis, golf and baseball. In order to develop player ability, practice courts or alleys have been devised and marked off in the manner of the game involved; for example, tennis with a back court, a mid court, a fore court, and with a usual net. In order to conserve space, the half court has been developed for tennis practice alleys on a half court length, and the strategic areas of the absent and opposite half court being simulated in a damping screen that absorbs the impact of tennis balls driven thereagainst by a player working the first mentioned half court. As will be described, there is a usual net and the damping screen is hung vertically at a short distance behind the net; the damping screen being marked off in target areas which indicate various ball plays with respect to the absent opposite court half. It is necessary that the balls played over the net have their energy completely absorbed without bouncing back into the playing area, and to this end the free hanging screen is employed and from which the balls drop immediately behind the net and into a contained area for recycling through a ball machine characterized by a ball feeder and server motorized to recycle balls to the practice player on the half court, and all of which is installed within a berm disposed transversely of the court beneath the net.

In practice, the hanging screen is marked off into target areas to designate the impacts of tennis balls on trajectories toward the various strategic areas of the opposite, but absent, half court and namely the back court, the mid court, the fore court, and also to represent drive balls as well as lob balls. Velocity then has its affect upon the tennis balls impacting upon the aforesaid simulated areas of the damping screen, and it is an object of this invention to provide means to sense and/or categorize the velocity or impact forces of the balls upon the screen at each of the aforesaid designated areas. For example, a lob or drive ball traveling at excessive speed would be sensed as out of bounds; a ball traveling at moderate speed would be sensed as returnable; and a ball traveling at insufficient speed would be sensed as defeatable. It is to be understood that the target area designations, their proportions and values, and their relationship to velocity can be varied and applied as circumstances require, for instance to be adjusted to players having different abilities, experience and/or compensating for recognized classes of players.

An object of this invention is to provide sensor means cooperatively combined with a damping screen, to indicate impact with a restricted area thereof, without interferring with the energy absorbing efficiency of the screen. In practice, the screen is a sheet of pliable impact resistant material that will not rip or tear, such as for example a plastic sheet hung vertically. A feature of the present invention is that the sensor means is carried by the sheet, at the back side thereof, and preferably a separate sensor for each target area to be distinguished in scoring.

It is also an object of this invention to provide a sensor means that responds to indicate ball impacts of varying velocities, for example excessive, moderate or insufficient velocity. These comparative impacts are associated with designated areas where they have a recognized effect, as for example with the drive ball area and lob ball area.

It is still another object of this invention to provide scoring means as related to both area and velocity impact thereupon by tennis balls returned over the net to a damping screen, as above referred to; a scoring means that applies recognized values to the return plays as sensed by the impact upon the aforesaid designated areas. In carrying out this invention, the scoring means is electrical with a counter means to add and subtract from a player's score and commensurate with his ability to return tennis balls into impact engagement with strategic areas of the damping screen.

DRAWINGS

The various objects and features of this invention will be fully understood from the following detailed description of the typical preferred forms and applications thereof, throughout which description reference is made to the accompanying drawings, in which.

PREFERRED EMBODIMENT

This invention relates to tennis training and especially to half courts automated to serve and to retrieve tennis balls that are returned by a player. A feature is the emmission of balls from the area of the playing net, with random variations in spotting. Ball retrieval is accomplished at a low berm disposed beneath the net and over which the return balls pass either over or below the net, including net balls that will normally drop behind the berm. The automation of such a court or practice alley is the subject matter of my co-pending application Ser. No. 664,376 filed Mar. 5, 1976, entitled TENNIS BALL SERVER AND COURT INSTALLATION. As disclosed in said co-pending application, and as shown herein, the berm provides a ramp that ascends toward the net to an elevation coincidental with the outward reaches of opposite ball runs that descend from the sides of the court or lane to the center thereof, transversely and/or beneath the playing net. A ball feeder means Y and server means Z (not detailed herein) are installed within the confines of the berm to recycle tennis balls that gravitate to the feeder to be dispensed into the server at a controlled rate. The server means Z operates to consecutively deliver tennis balls through a window W and to spot the same at random, as a function of dissimilar phase operation of elevation and traverse means incorporated therein and both of which operate out of phase with respect to the feeder means Y. The operative means of the server are motivated by variable speed electrical motor drives.

Figure 1:
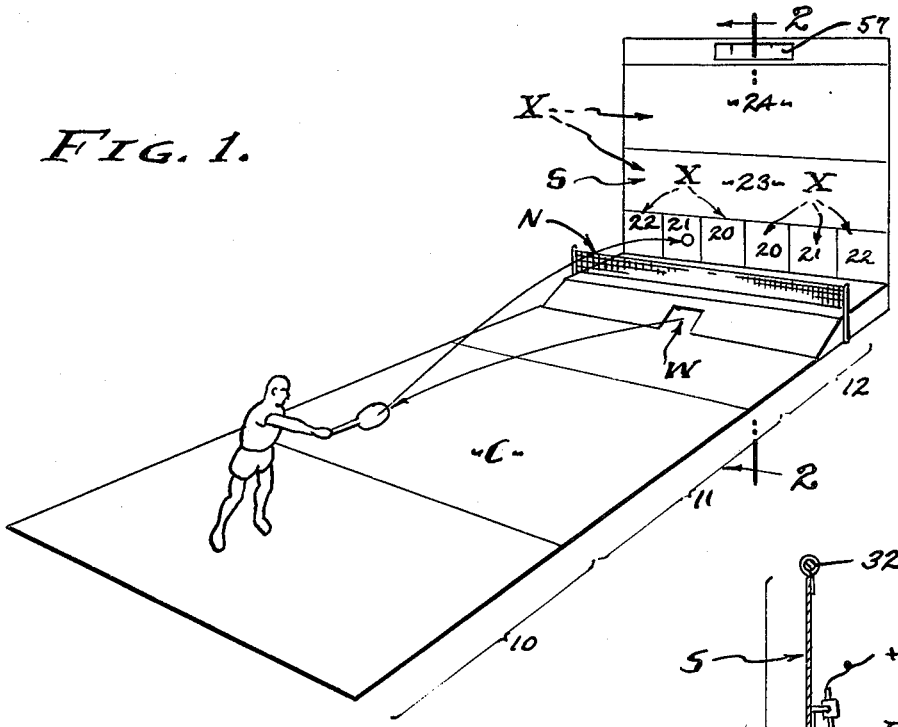
FIG. 1 is a perspective view illustrating a typical tennis court installation of the velocity sensing and scoring device.
Figure 2:
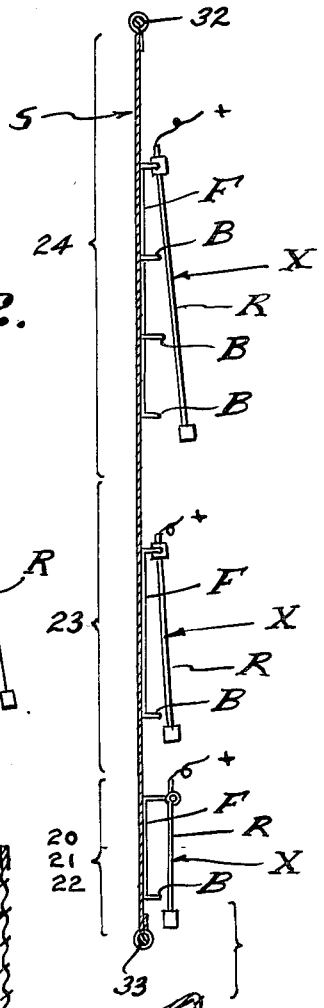
FIG. 2 is a sectional view taken substantially as indicated by line 2—2 on FIG. 1.
Figure 3:
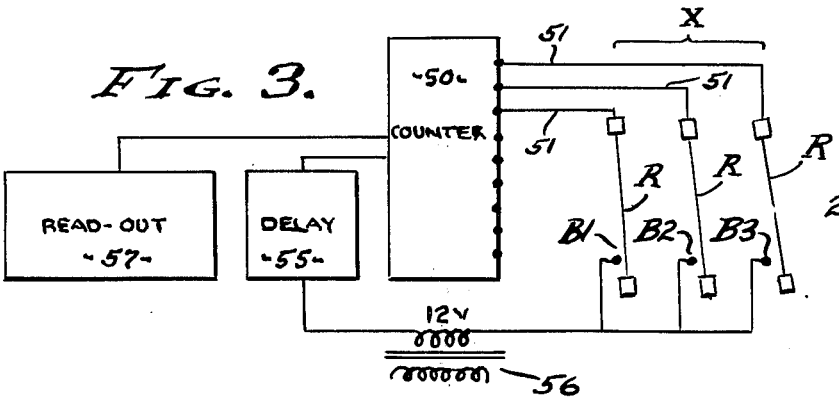
FIG. 3 is an electrical block diagram illustrating the sensor means involved.
Figure 3:
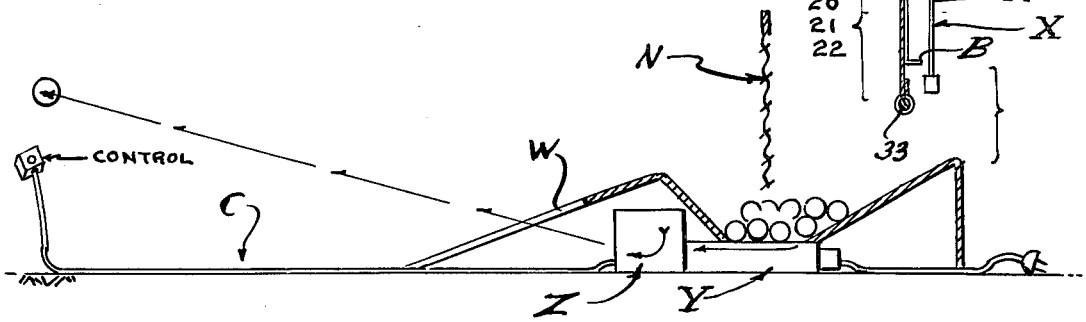

The half court C as it is shown in FIG. 1 is comprised of one half length and one half width of a normal court and substantially proportionate with accepted court dimensions being marked off into a back court area 10, a mid court area 11, and a fore court area 12. Therefore, it is essentially a quarter court that is involved, in which the server means Z spots the tennis balls to be returned by the player over the net and to the damping screen. According to the game of tennis, the return ball trajectory is diagonal with respect to the court plane as related, for example, to serves into the simulated opposing but absent half court. To these ends, there is a damping screen S marked off in target areas recognized as the strategic areas for placement of the return balls. Therefore, the damping screen format has target areas 20, 21, and 22 corresponding to the simulated areas of the said opposing but absent half court; and these target areas are disposed in serving groups to one side and the other of the screen S, in order to accommodate diagonal ball trajectories emanating from right and left portions of the court C. In addition, the screen format includes a drive area 23 above the serve areas 20–22, and there is also a lob area 24 above the said drive area. These target areas, as shown, are generally accepted as the strategic ball placement areas to which the player strives to return the ball with accuracy.

Referring now to the damping screen S, an opaque sheet of eight to ten ounce plastic material is employed, extending the full width of the court C and to a height of ten to fifteen feet. The screen material is flexible and supple and marked off into the aforesaid strategic target areas by coloration and/or by division lines. For example and as shown, the separate areas are fabricated in distinguishably colored panels 30 joined into the composite format as by means of border tapes 31. Alternately, a solid sheet can be painted or the like. In carrying out this invention, the damping screen S is hung so as to depend vertically several feet behind the playing net N, the serve area targets extending approximately one foot above and below the top edge of said net. As shown, there are right and left groups of serve targets 20–22 beneath a transversely coextensive drive target 23 extending upwardly 3 to 4 feet, and above which there is the transversely coextensive lob target 24 extending to the total height of 10 to 15 feet. The damping screen is hung as a curtain, for example between parallel upper and lower rungs 32 and 33.

In accordance with this invention there is provided impact sensor means X responsive to the impact of tennis balls against the front of the damping screen S and operable to detect ball velocity within determined ranges. As shown, there is at least one sensor means X associated with each target area, to respond to impact in each instance and select ones to also detect, for example, high and medium and low velocities of ball impact. The sensor means X are essentially alike and each comprises a contact frame F and at least one switch rod R suspended from the frame and engageable with an electrically conductive contact bar B carried by said frame. The frame F is attached to the back side of the damping screen S, and to this end there is a mounting means M therefor to hold said frame contiguous to the panel 30 which is the target to be monitored by the sensor means involving the mounted frame. As shown, there is a single sensor means X for each serve target area 20–22, while there is a plurality of sensor means X in a transverse series across the drive and lob target areas 23 and 24. A feature of this sensor means is the minimum mass involved therein as next described.

The contact frame F is a lightweight structure attached to the back side of the panel 30 comprising the target area to be sensed and includes a header 35 to carry the switch rod R and a means 36 depending from the header to carry the contact bar B to be engageable by said rod. In practice, the frame F is a flexible element made of resilient material such as a length of spring wire held contiguous to the panel 30 by stand-off type mounting means securing the header 35 and contact bar B in crossed spaced relation. In the preferred form, the contact frame F is a perimeter frame of lightweight spring wire, of rectangular configuration comprising spaced horizontally disposed header 35 and a contact member forming the bar B integral with spaced vertically disposed side rails 36. For the purpose of suspending the switch rod R, by gravity, in spaced relation to the contact member of bar B, the header 35 is spaced a greater distance from the panel 30 than the said contact member or bar, and as shown the header 35 and contact member are spaced from the rails 36 by corner legs 38 extending integrally therebetween.

The mounting means M can vary to accommodate variations in the structure of the contact frame F, to hold the frame juxtapositioned to the back plane of the panel 30. As shown, each corner of the frame is held spaced from the panel 30 by a stand-off type attachment in the form of a fastner stud 39 projecting from the frame and secured through the panel by spaced washers 40 embracing the same. In practice, the washers are threaded so as to lock onto the stud when tightened, and they are tapered discs of flexible plastic adapted to yield to impact without tearing the panel sheet.

The switch rod R is a straight member of flexible and resilient wire, carried by the header 35 to depend adjacently inward of the member 36 or contact bar B in spaced relation thereto. In the first form shown in FIG. 4 the switch rod R is a straight electrically conductive member free to swing by gravity and is loosely pivoted to the header 35 over a dielectric sleeve 40 and positioned thereon by collars 41. In the form shown in FIG. 5 the switch R′ is a straight member free to swing into conductive engagement with a plurality of spaced members 36 establishing contact bars B1, B2 and B3. In the form shown in FIG. 6 there is a plurality of switch rods R1, R2 and R3 and each is a straight member anchored by insulators to the header 35 and adjustably spaced from the contact member B establishing the contact bar B, each responsive to a distinct velocity or impact value. As stated and as shown, the rods R1, R2 and R3 are slendar so as to be of minimum mass and are inherently of low inertia value and/or of low spring rate. Therefore, a weight 42 in the nature of a pendulum is secured to the terminal end of each rod, to be effective so as to cause conductive engagement with contact bar B when the latter is carried by the panel 30 upon ball impact to move rearwardly. Consequently, there will be a momentary electrically conductive contact made between the contact bar B and switch rod R.

Figure 4:
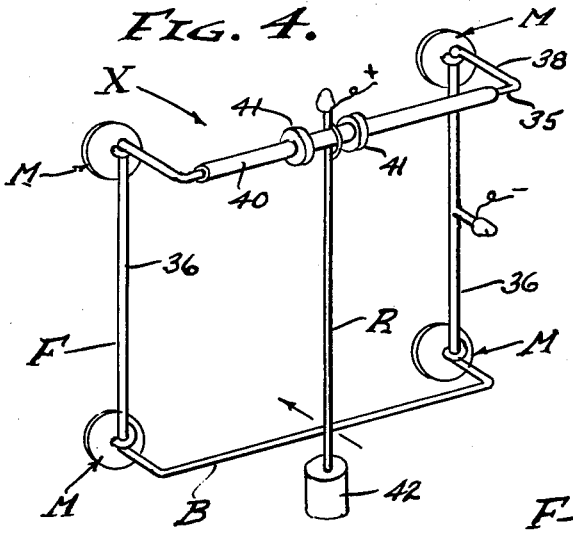
FIGS. 4, 5 and 6 are perspective views of the various forms of sensor means hereinafter described, FIG. 4 showing the mounting means therefor.

Referring to the sensor means X of FIG. 4, the ball impact required to cause electrically conductive engagement of switch rod R with contact bar B is determined by the depending length of said rod R, its mass as supplemented by the weight 42, and by the spacing of the rod from said bar. It is to be understood that mass inertia of the damping screen S has its initial affect upon absorbing energy from the impacting ball, and that the sensor means X responds to the resulting movement as a consequence of said ball impact. In this form, the rod R is free to swing with the weight 42 acting as a pendulum and such as to return the rod by gravity to a perpendicular position after each displacement as caused by a ball impact.

Figure 5:
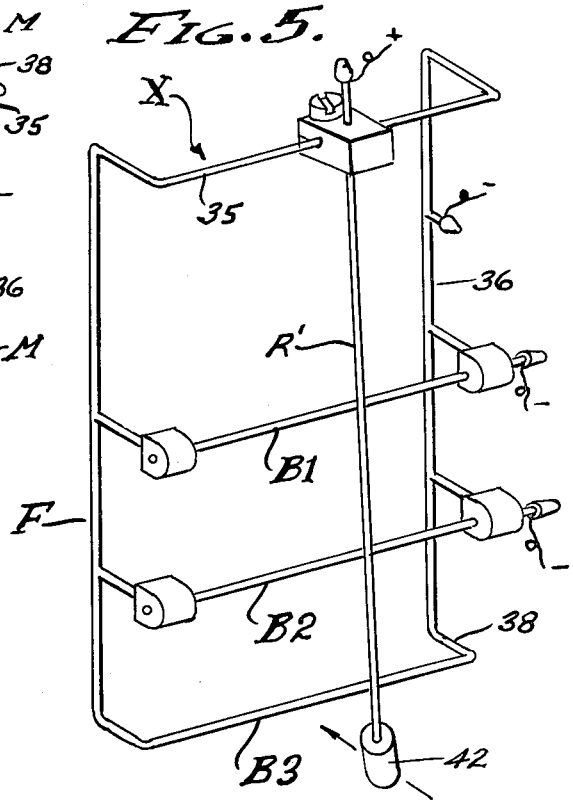
Figure 7:
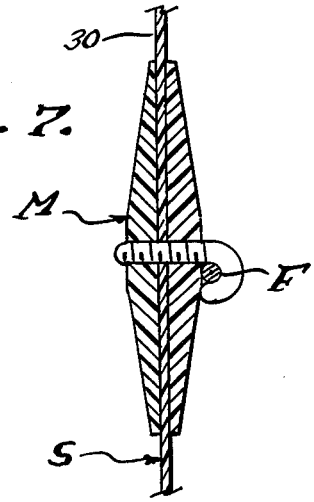
FIG. 7 is an enlarged sectional view of the mounting means M for the said sensor means.
Figure 8:
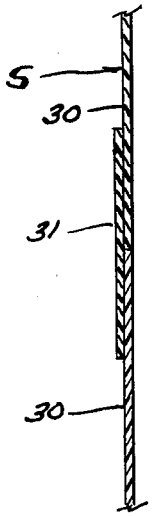
FIG. 8 is an enlarged sectional view of the joinder between the target areas of the damping screen.

Referring to the sensor means X of FIG. 5, the ball impact caused to determine velocity is sensed by the depending length of switch rod R' trained over the spaced contact bars B1, B2 and B3 that are progressively engageable thereby. Again, the inertia of the damping screen S has its initial affect and the separate bars B1, B2 and B3 are successively engaged by rod R' to the extent of the impact force applied as a result of balls striking the target area or panel 30 to move the frame F and sensor means carried thereby.

Figure 6:
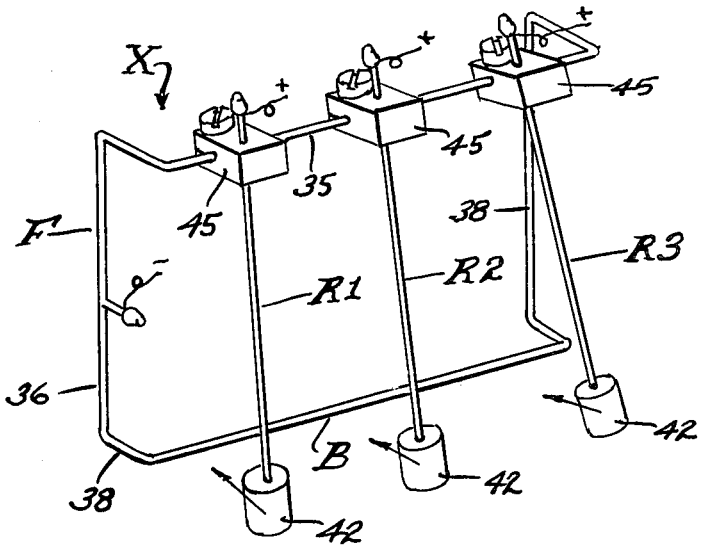

Referring to the sensor means X of FIG. 6, the ball impact is measured by the plurality of rods R1, R2 and R3 and each is responsive to pre-determined impact force applied as a result of balls striking the target area or panel 30. In this form, the rods are adjustably secured to the header 35 as by insulating clamp means 45, so that the mass of the rod as supplemented by the weight 42 results in deflection of the rod and its conductive engagement with the contact bar B. It will be seen how the initial spacing of the rod R and bar B is determined by rotation of the clamp means 45 on the header 35, the rods R being adjusted to contact the bar B with the application of high, moderate and low impact forces, respectively.

In accordance with this invention there is scoring means D responsive to the electrical contacts made by the plurality of sensor means X at the multiplicity of strategic target areas 10–24. Each of the switch rods R1, R2 and R3 is connected to a counter means 50 through a line 51, to pre-determined terminals such as the terminals thereof as indicated. Each of said terminals is associated with a target area and/or with the ball velocity detection rods of the sensor means X. With the sensor means X of FIG. 4, a contact signal or pulse is conducted over line 51, such as used with a simple serve target 10–12 where velocity may not be of great concern. With the sensor means X of FIG. 5, a complex signal or signals emanate as a result of the successively engageable contact bars B1, B2 and B3, such as used with a drive or lob target area 23 and 24 where velocity determines a good or bad play; for example a high velocity lob ball would be "out-of-bounds." Therefore, the scoring means D includes the counter means 50 with logic terminals, say for example 1–9, which add or substract score according to the values applied to the ball plays of the game. Also included in the scoring means D is a time delay means 55, for example a 1-second delay, which responds to each initial ball impact signal and thereafter deactivates the responsive circuits of the counter means 50, so that rebound action of the damping screen S and of the sensor means X carried thereby does not confuse the true score with subsequent contacting that can and in all probability will result as movements subside. The electrical system is preferably a low voltage system, 12 volts, powered as by a transformer power supply 56, and the counter means 50 operates a readout 57 that is audible and/or visible to the player to record and/or display his score and playing abilities.

Having described only typical preferred forms and applications of my invention, I do not wish to be limited or restricted to the specific details herein set forth, but wish to reserve to myself any modifications or variations that may appear to those skilled in the art.

I claim:

1. A scoring device for sensing the impact of balls and including, a flexible damping screen of supple sheet material hung as a curtain in a vertical plane to moveably yield to and thereby absorb the impact of balls impinging thereagainst, at least one electrically conductive contact bar suspended by the curtain, at least one substantially resilient, electrically conductive switch rod suspended by the curtain in spaced opposition to said at least one bar, means normally holding said at least one bar and rod in said spaced opposition, said at least one rod being stabilized by its inertia and freely swingable to be engaged by said at least one bar moved thereagainst by impact of a ball against said damping screen, and electrical sensor means responsive to engagement of said at least one bar with said at least one rod to indicate ball impact against said damping screen.

2. The ball scoring device as set forth in claim 1, wherein said at least one switch rod is carried by a frame attached to the screen, said frame includes said at least one contact bar as a part thereof.

3. The ball scoring device as set forth in claim 1, wherein said at least one switch rod is pivotally carried by mounting means attached to said damping screen and inertially free to be engaged by the said at least one bar.

4. The ball scoring device as set forth in claim 1, wherein said at least one switch rod is adjustably attached to said anchored by mounting means to the damping screen.

5. The ball scoring device as set forth in claim 1, wherein said at least one switch rod is a adjustably attached to a frame, said frame including said at least one including the contact bar.

6. A scoring device for sensing variable impact of balls and including, a flexible damping screen of supple sheet material hung as a curtain in a vertical plane to moveably yield to and thereby absorb the impact of balls impinging thereagainst, a plurality of vertically spaced and horizontal electrically conductive contact bars carried by the damping screen, a resilient electrically conductive switch rod fixedly attached by clamp means to said damping screen and depending substantially vertical and in spaced opposition to said bars; said rod having weight means at its lower end whereby bending of said rod is caused by a certain impact force exerted by a ball impacting against said damping screen cause consecutive engagement of said rod with said bars; said rod being stabilized by its inertia to be engaged by the said bars moved thereagainst and electrical sensor means responsive to engagement of the bars and rod to indicate ball impact against the damping screen.

7. The ball scoring device as set forth in claim 6, wherein said switch rod is carried by a frame attached to said screen, said frame including said contact bars as a part thereof.

8. The ball scoring device as set forth in claim 6, wherein said switch rod is a resilient member adjustably attached to said damping screen.

9. The ball scoring device as set forth in claim 6, wherein said switch rod is a resilient member attached to a frame, said frame including said contact bars.

10. The ball scoring device as set forth in claim 6, wherein said switch rod is a resilient member adjustably attached to a frame, said frame including said contact bars.

* * * * *